United States Patent [19]

Niizato et al.

[11] Patent Number: 4,928,641

[45] Date of Patent: May 29, 1990

[54] LUBRICANT SUPPLYING SYSTEM FOR DOHC TYPE MULTI-CYLINDER INTERNAL COMBUSTION ENGINE

[75] Inventors: Tomonori Niizato; Tsuneo Tanai; Kazuhiro Kasahara; Tsutomu Saka; Toshihiro Oikawa, all of Saitama, Japan

[73] Assignee: Honda Giken Kogyo Kabushiki Kaisha, Tokyo, Japan

[21] Appl. No.: 290,313

[22] Filed: Dec. 27, 1988

[30] Foreign Application Priority Data

| | | | |
|---|---|---|---|
| Dec. 28, 1987 | [JP] | Japan | 62-200642[U] |
| Jun. 22, 1988 | [JP] | Japan | 63-82587[U] |
| Jun. 22, 1988 | [JP] | Japan | 63-82588[U] |
| Aug. 1, 1988 | [JP] | Japan | 63-102104[U] |
| Aug. 1, 1988 | [JP] | Japan | 63-102105[U] |

[51] Int. Cl.[5] ..... F01L 1/26

[52] U.S. Cl. ..... 123/90.16; 123/196 M; 123/90.33

[58] Field of Search ..... 123/90.34, 90.16, 196 M, 123/90.33

[56] References Cited

U.S. PATENT DOCUMENTS

| | | | |
|---|---|---|---|
| 3,628,513 | 12/1971 | Grosseau | 123/90.34 |
| 4,441,465 | 4/1984 | Nakamura | 123/90.34 |
| 4,535,732 | 8/1985 | Nakano et al. | 123/90.16 |
| 4,621,597 | 11/1986 | Kawada et al. | 123/90.34 |
| 4,656,977 | 4/1987 | Nagahiro et al. | 123/90.16 |
| 4,709,667 | 12/1987 | Ichihara et al. | 123/90.34 |
| 4,800,850 | 1/1989 | Yoshida et al. | 123/90.34 |
| 4,807,574 | 2/1989 | Shibata et al. | 123/90.34 |

*Primary Examiner*—E. Rollins Cross
*Attorney, Agent, or Firm*—Lyon & Lyon

[57] ABSTRACT

A lubricant supplying system for a DOHC type multi-cylinder internal combustion engine comprising a plurality of cylinders arranged in series in a cylinder block, a pair of cam shafts parallel to each other and rotatably supported by a cylinder head and cam holders fixed to the cylinder head at opposite sides of the respective cylinders along the cylinder arranging direction, a plurality of cams including low speed cams corresponding to intake and exhaust valves of the respective cylinders and fixed to the cam shafts, a plurality of rocker arms in slidable contact with the respective cams corresponding to the intake and exhaust valves of the respective cylinders, and a connection switching mechanism for switching connection and disconnection of the rocker arms in response to a hydraulic pressure to vary the operating states of the valves responsive to the operating state of the engine, wherein a hydraulic pressure supply passage independent from an oil supply passage for supplying a hydraulic pressure to the connection switching mechanism is provided in the cylinder head substantially at its center portion along the cylinder arranging direction so as to extend vertically, and a branch oil passage is provided to have intake and exhaust side portions disposed in one cam holder of substantially center location along the cylinder arranging direction for communicating with the upper end of the hydraulic pressure supply passage to supply oil to the slidably contacting portions of low speed cams of the respectively cylinders at both intake and exhaust sides with the rocker arms and the cam journal portions of the cam shafts.

6 Claims, 15 Drawing Sheets

LUBRICANT SUPPLYING SYSTEM FOR DOHC TYPE MULTI-CYLINDER INTERNAL COMBUSTION ENGINE

BACKGROUND OF THE INVENTION

1. Field of the Invention

The present invention relates to a lubricant supplying system for a DOHC type multi-cylinder internal combustion engine having a plurality of cylinders arranged in series in a cylinder block, a pair of cam shafts parallel to one another and rotatably supported by a cylinder head and a cam holder which is fixed to the cylinder head at opposite sides of the respective cylinders along the cylinder arranging direction, a plurality of cams including low speed cams corresponding to intake and exhaust valves of the respective cylinders and fixed to the cam shafts, a plurality of rocker arms disposed to be slidably contacted with the respective cams and corresponding to each of the intake and exhaust valves of the respective cylinders, and a connection switching mechanism for switching connection and disconnection of the rocker arms in response to a hydraulic pressure to vary operating states of the intake and exhaust valves responsive to an operating state of the engine.

2. Description of the Prior Art

Conventionally, such internal combustion engine has been known, for example, from Japanese Patent Application Publication Kokai No. 121812/1987.

In such an internal combustion engine, the hydraulic pressure of a connection switching mechanism is varied in response to the operating state of the engine, and it is desirable that the influence of the operation of the connection switching mechanism does not influence the supply of lubricant.

SUMMARY OF THE INVENTION

It is therefore an object of the present invention to provide a lubricant supplying system for a DOHC type multi-cylinder internal combustion engine which is set free of the above-noted problems, simple in structure and can stably supply lubricant irrespective of the operation of a connection switching mechanism.

According to the present invention, the above object is accomplished by providing a lubricant supplying system for a DOHC type multi-cylinder internal combustion engine in which a hydraulic pressure supply passage independent from a lubricant supply passage for supplying a hydraulic pressure to a connection switching mechanism is provided in a cylinder substantially at the center along the arranging direction of cylinders to be vertically extended, and a branch lubricant passage is provided to be branched to the intake and exhaust sides in a cam holder disposed substantially at the center along the arranging direction of the respective cylinders for communicating with the upper end of the hydraulic pressure supply passage to supply lubricant to the slidably contacting portions of low speed cams of the respective cylinders at both intake and exhaust sides with the rocker arms and the cam journal portions of the cam shafts.

According to the arrangement described above, the lubricant is supplied to the slidably contacting surfaces of the low speed cams with the rocker arms and the cam journal portions of the cam shafts irrespective of the operation of the connection switching mechanism, and the hydraulic pressure supply passage and the branch lubricant passage are disposed substantially at the center along the arranging direction of the respective cylinders. Therefore, it can prevent a time lag of supplying the lubricant to the portions to be lubricated, and can substantially equalize flowing pressure loss of the lubricant to the portions to be lubricated, thereby uniformly supply the lubricants to the respective portions to be lubricated. Further, only one hydraulic pressure supply passage is provided, the fabrication of the cylinder head becomes simple.

According to another aspect of the invention, a low speed hydraulic pressure supply passage is provided substantially at the center along the arranging direction of the respective cylinders in the cylinder head and, a high speed hydraulic pressure supply passage opened at one end face along the arranging direction of the respective cylinders is provided independent from the low speed hydraulic pressure supply passage. Branch lubricant passages for supplying lubricant to slidably contacting portions of the cams, including at least the low speed cams of the respective cylinders at the intake and exhaust sides with the rocker arms, and the branch lubricant passages communicating with the low speed hydraulic pressure supply passage to supply the lubricant to the cam journals of the cam shafts are provided to be branched at the intake and exhaust sides at the cam holder disposed substantially at the center along the arranging direction of the respective cylinders. The connection switching mechanisms and the lubricant supply passage for supplying the lubricant to the sliding contacting portions of the high speed cams with the rocker arms are coaxially provided in both the rocker shafts, a connection passage for communicating through both the lubricant supply passages is provided in the cylinder head near one end along the arranging direction of the respective cylinders, and a lubricant supply port opened at one end face of the cylinder head is provided in communication with one lubricant supply passage. A switching valve for switching the communication and the disconnection between the opening of the high speed hydraulic pressure supply passage and the lubricant supply port is mounted at one end face of the cylinder head.

According to the arrangement described above, the lubricant supply to the slidably contacting portions of the cams including at least the low speed cams with the rocker arms and the cam journals, and the lubricant supply to the connection switching mechanism and the slidably contacting portions of the high speed cams with the rocker arms are conducted independently from each other. Therefore, the lubricant is always sufficiently supplied to the slidably contacting portions of the cams including at least the low speed cams with the rocker arms and the cam journals irrespective of the connection switching mechanism supplied with the lubricant in response to the operating state of the engine. Further, since the low speed hydraulic pressure supply passage and the branch lubricant passage are disposed substantially at the center along the arranging direction of the respective cylinders, it can prevent a time lag of supplying the lubricant to the portions to be lubricated, and the flowing pressure loss to the portions to be lubricated can be substantially equalized to equalize the quantities of the lubricants to the respective portions to be lubricated. In addition, the lubricant supplies of the connection switching mechanisms can be switched at between the intake and exhaust sides merely by mounting a single switching valve at one end face of the cylinder head, and, further, since only one low and high speed hydraulic pressure supply passages are provided in the cylinder head, the fabrication of the cylinder head becomes simple.

The above and other objects, features and advantages of the invention will become apparent from reading of the following description taken in conjunction with the accompanying drawings.

BRIEF DESCRIPTION OF THE DRAWINGS

FIGS. 1 to 12 illustrate one embodiment of the present invention, wherein FIG. 1 is a longitudinal sectional view of the essential portion of an internal combustion engine in section taken along line I—I of FIG. 2, FIG. 2 is a view as seen from arrows with lines II—II of FIG. 1; FIG. 3 is a sectional view taken along line III—III of FIG. 2; FIG. 4 is a sectional view taken along line IV—IV of FIG. 1; FIG. 5 is a sectional view taken along line V—V of FIG. 2; FIG. 6 is a lateral sectional view for showing a connection switching mechanism; FIG. 7 is a view showing a lubricant supplying system; FIG. 8 is a view as seen from arrows with lines VIII—VIII of FIG. 2; FIG. 9 is a sectional view taken along line IX—IX of FIG. 8; FIG. 10 is an enlarged sectional view taken along line X—X of FIG. 8 when a switching valve is closed; FIG. 11 is a sectional view taken along line XI—XI of FIG. 2; and FIG. 12 is a sectional view corresponding to FIG. 10 when the switching valve is opened.

FIGS. 13 to 15 illustrate another embodiment of the present invention, wherein FIG. 13 is a view of a lubricant supply system corresponding to FIG. 7; FIG. 14 is a plan view corresponding to FIG. 2; and FIG. 15 is a view as seen from arrows with lines XV—XV of FIG. 14.

DESCRIPTION OF THE PREFERRED EMBODIMENTS

The present invention will now be described by way of embodiments with reference to the accompanying drawings.

Figure 1:
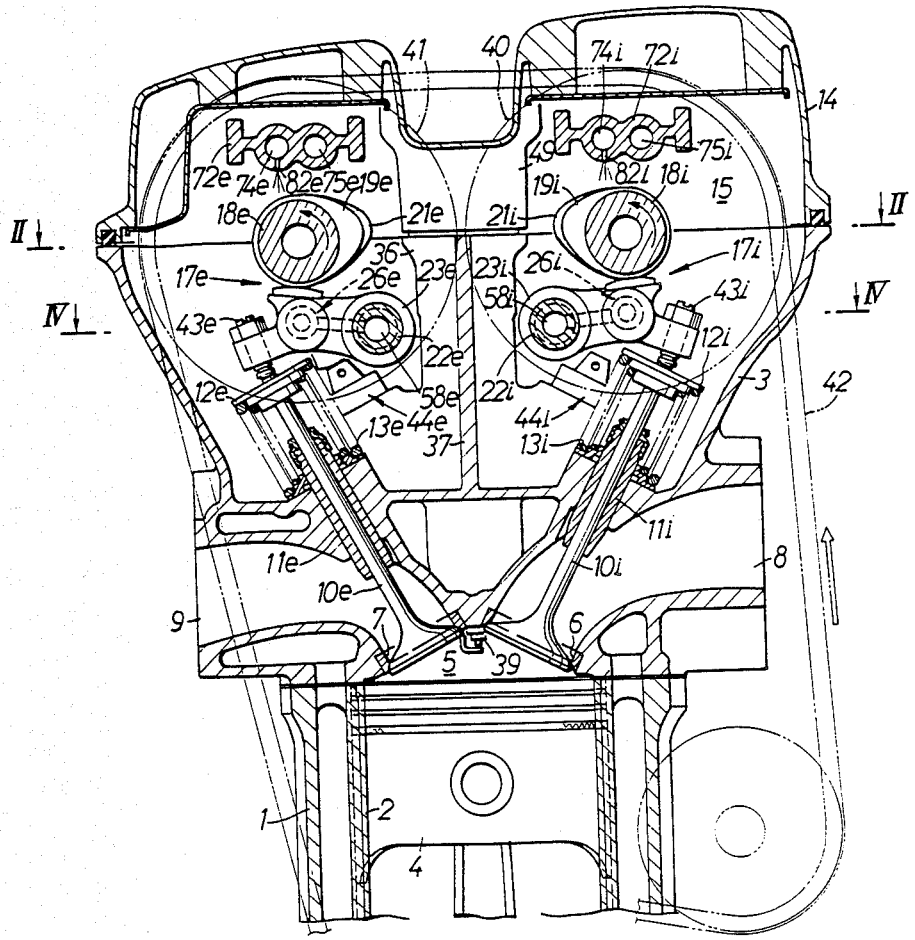
Figure 2:
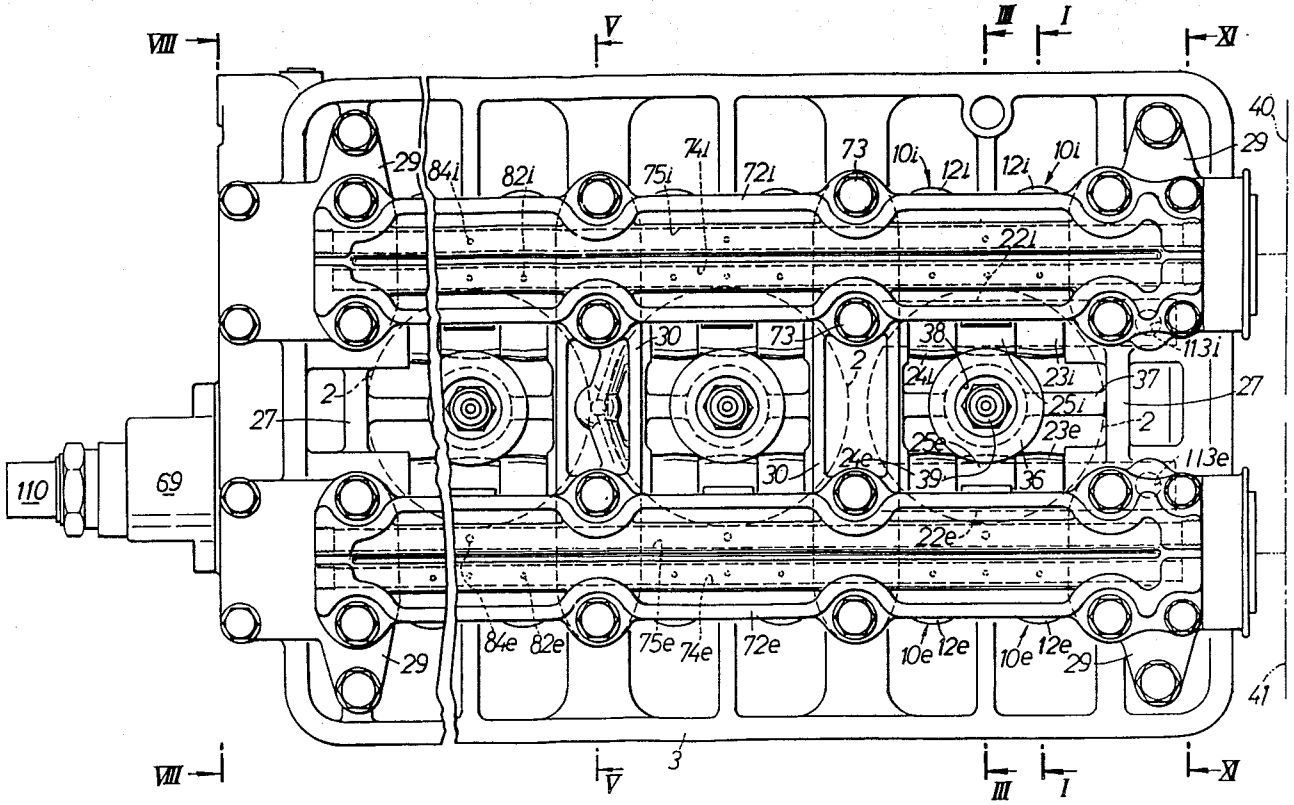

Referring first to FIGS. 1 to 12, an embodiment of the present invention will now be described. In FIGS. 1 and 2, in this DOHC type multi-cylinder internal combustion engine, four cylinders 2 are aligned in series in a cylinder block 1, and combustion chambers 5 are defined between a cylinder head 3 coupled to the upper end of the cylinder block 1 and pistons 4 slidably fitted into the respective cylinders 2. At the cylinder head 3 are formed a pair of intake openings 6 and a pair of exhaust openings 7 at the portions forming the ceilings of the respective combustion chambers 5. The intake openings 6 respectively communicate with intake ports 8 opened on one side face of the cylinder head 3, and the exhaust openings 7 respectively communicate with exhaust ports 9 opened on the other side face of the cylinder head 3.

Guide cylinders **11*i* and 11*e* are respectively fixedly secured to the portions of the cylinder head 3 corresponding to the cylinders 2 to guide a pair of intake valves 10*i* for opening and closing the respective intake openings 6 and a pair of exhaust valves 10*e* for opening and closing the respective exhaust openings 7. Valve springs 13*i* and 13*e* are respectively provided in resiliently contraction manner between the collars 12*i* and 12*e* formed at the upper ends of the intake and exhaust valves 10*i* and 10*e* protruded upwards from the guide cylinders 11*i* and 11*e* and the cylinder head 3 to thereby urge the intake and exhaust valves 10*i* and 10*e*** upwards, i.e., in valve closing direction.

An operation chamber 15 is formed between the cylinder head 3 and a head cover 14 coupled to the upper end of the cylinder head 3. In the operation chamber 15 are contained and disposed an intake side valve actuating unit **17*i* for driving to open or close the intake valves 10*i* in the respective cylinders 2 and an exhaust side valve actuating unit 17*e* for driving to open or close the exhaust valve 10*e* in the respective cylinders 2. Both the valve actuating units 17*i* and 17*e* fundamentally have the same structure. In the foregoing description, one of the valve actuating units 17*i* and 17*e*** will be described in detail with suffix "i" or "e" to the reference numerals, and the other will be merely illustrated by adding suffix "i" or "e" to the reference numerals.

Figure 3:
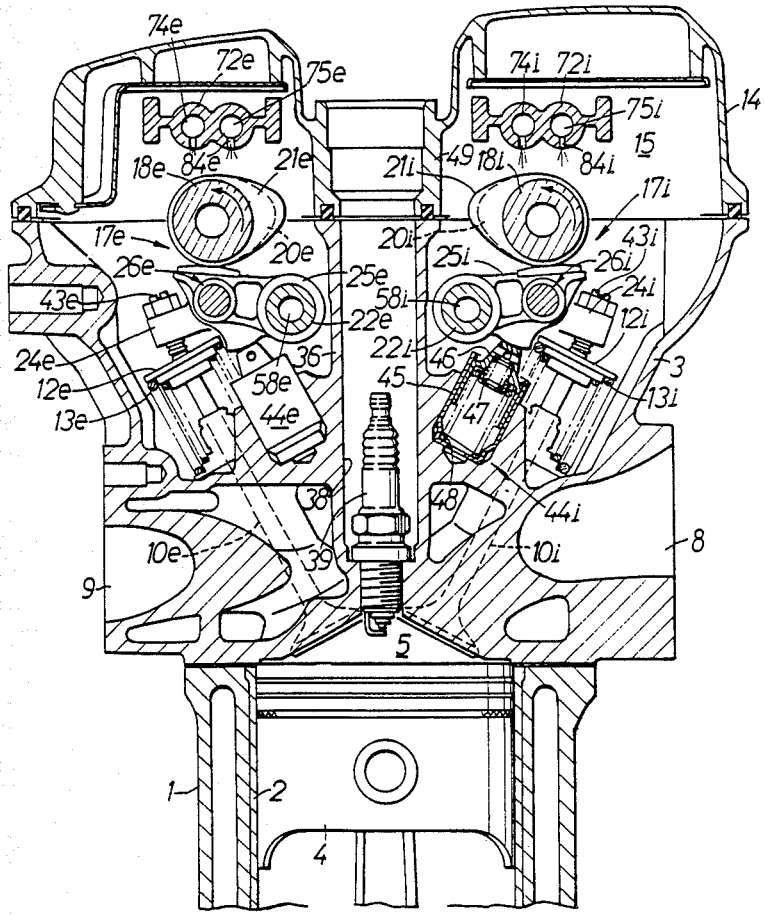
Figure 4:
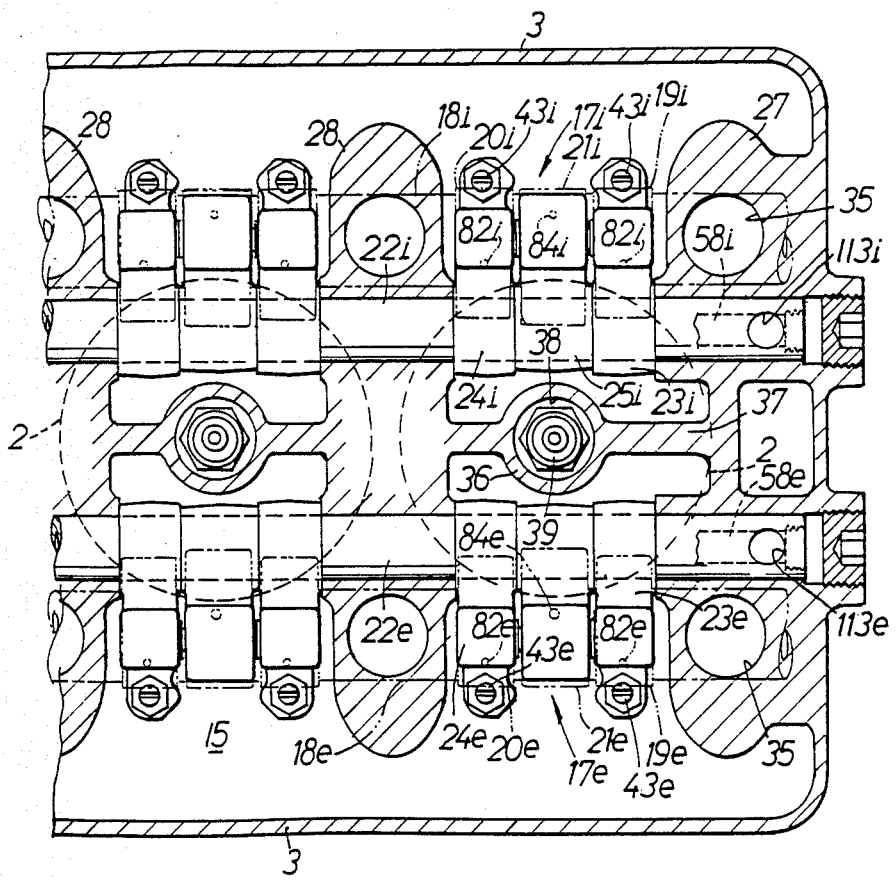

Referring to both FIGS. 3 and 4, the intake side valve actuating unit **17*i* includes a cam shaft 18*i* rotatably driven at a reduction gear ratio of ½ from the crankshaft (not shown) of the engine, low speed cams 19*i* and 20*i* and high speed cams 21*i* provided at the cam shaft 18*i* corresponding to the respective cylinders 2, rocker shafts 22*i* fixedly disposed in parallel with the cam shaft 18*i*, first driving rocker arms 23*i*, second driving rocker arms 24*i* and free rocker arms 25*i* pivotally secured to the rocker shaft 22*i* corresponding to the respective cylinders 2, and hydraulic connection switching mechanisms 26*i* provided among the rocker arms 23*i*, 24*i*, 25*i* corresponding to the respective cylinders 2**.

Figure 5:
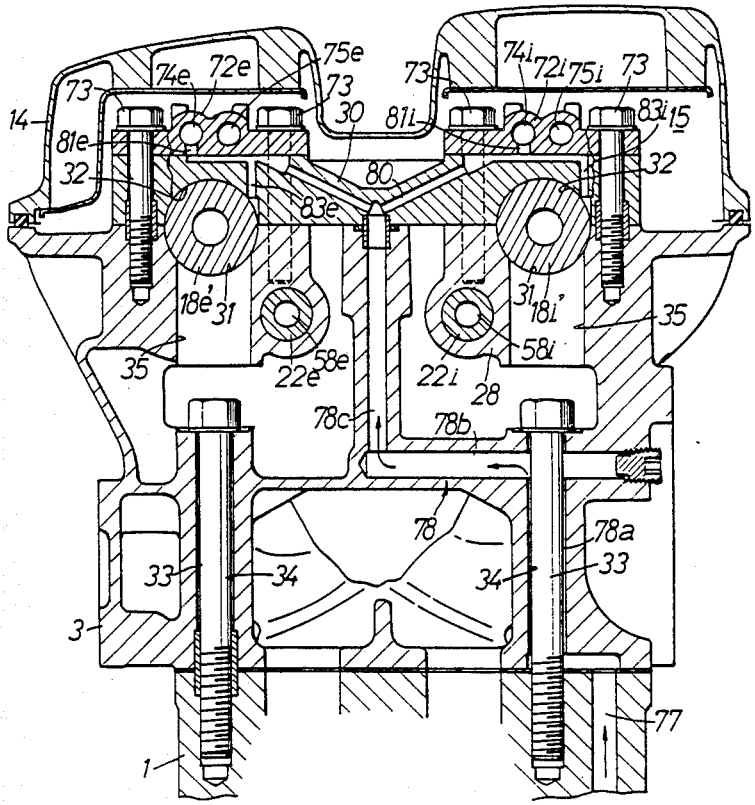

Referring also to FIG. 5, the cam shaft **18*i* is arranged rotatably around an axis in parallel with the arranging direction of the respective cylinders 2 above the cylinder head 3. Namely, at the cylinder head 3 are provided integrally cam supports 27 and 27 at both ends thereof along the arranging direction of the respective cylinders 2, three cam supports 28, . . . are integrally provided at the corresponding positions between the cylinders 2, and the cam shaft 18*i* is supported rotatably around the axis by cam holders 29 and 29 fitted onto the cam supports 27 and 27 of both ends, cam holders 30, . . . fitted onto the three cam supports 28, . . . , and the cam supports 27, 27 and 28, . . . . Further, the cam holders 29 are independently provided at the intake and exhaust side valve actuating units 17*i* and 17*e*, respectively, while the cam holders 30 are commonly arranged at both the valve actuating units 17*i* and 17*e*. On the upper surfaces of the cam supports 27, 27 and 28, . . . are provided semicircular supporting faces 31 for supporting the outer peripheral surfaces of the lower halves of the cam shafts 18*i* and 18*e*, and on the lower surfaces of the cam holders 29 and 30 are provided semicircular supporting faces 32 for supporting the outer peripheral surfaces of the upper halves of the cam shafts 18*i* and 18*e***.

At the respective cam supports 27, 27 and 28, . . . are opened a pair of insertion holes 34 to which bolts 33 are inserted to screw the cylinder head 3 into the cylinder block 1 to be extended upwards and downwards at the positions corresponding to the cam shafts **18*i* and 18*e*, and operation holes 35 for rotatably operating the bolts 33 opened at the upper positions corresponding to the insertion holes 34 to be extended upwards and downwards while the upper ends are opened at the semicircular supporting faces 31**.

At the cylinder head 3 among the cam supports 27, 27 and 28, . . . at the portion corresponding to the center of the respective cylinders 2 is integrally provided a cylindrical central block 36 extending upwards and downwards, and the central block 36 is connected by supporting walls 27 to the cam supports 27, 27 and 28, . . . of both sides. A cylindrical central block 49 connected to the central block 36 is provided at the head cover 1. In the central blocks 36 and 49 are opened plug insertion holes 38, into which an ignition plug 39 fitted into the combustion chamber 5 is fitted.

At one ends projected from the cylinder head 3 and the head cover 14 of both the cam shafts **18*i* and 18*e* are fixedly secured timing pulleys 40 and 41, and a timing belt 42 for transmitting a driving force from a crankshaft (not shown) is suspended between both the timing pulleys 40 and 41. In this manner, both the cam shafts 18*i* and 18*e*** are rotated in the same direction.

The low speed cams **19*i* and 20*i* are integrated at the positions corresponding to the intake valves 10*i* with the cam shaft 18*i*, and the high speed cam 21*i* is integrated between both the low speed cams 19*i* and 20*i*. On the other hand, the rocker shaft 22*i* is fixedly held by the cam supports 27, 27 and 28, . . . at an axis parallel to the cam shaft 18*i* at a position lower than the cam shaft 18*i*. At the rocker shaft 22*i* are pivotally secured adjacently to each other the first driving rocker arm 23*i* operatively connected to one intake valve 10*i*, the second driving rocker arm 24*i* operatively connected to the other intake valve 10*i*, and the free rocker arm 25*i* disposed between the first and second driving rocker arms 28*i* and 24*i***.

Tappet screws **43*i* are respectively screwed into the first and second driving rocker arms 23*i* and 24*i* for advancing and retreating movements to be contacted with the upper ends of the intake valves 10*i* corresponding to the tappet screws 43*i*, thereby operatively connecting both the driving rocker arms 23*i* and 24*i* to the intake valves 10*i***.

The free rocker arm **25*i* is resiliently urged in a direction for slidably contacting with the high speed cam 21*i* by a lost motion mechanism 44*i* interposed to the cylinder head 3. The lost motion mechanism 44*i* includes a bottomed cylindrical guide member 45 fitted to the cylinder head 3 with the closed end disposed at the cylinder head 3 side, a piston 36 slidably fitted into the guide member 45 and contacted with the lower surface of the free rocker arm 25*i*, and first and second springs 47 and 48 interposed in series between the piston 46 and the guide member 45 to urge the piston 46 to the side of the free rocker arm 25*i***. *The first and second springs 47 and 48 are set with different spring constants from one another.*

Figure 6:
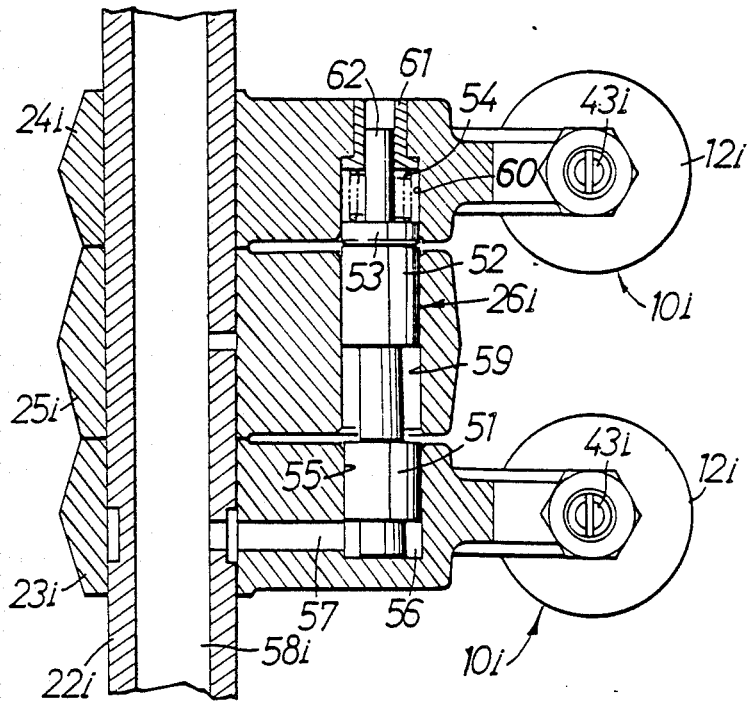

In FIG. 6, the connection switching mechanism **26*i* includes a first switching pin 51 for connecting between the first rocker arm 23*i* and the free rocker arm 25*i*, a second switching pin 52 for connecting between the free rocker arm 25*i* and the second driving rocker arm 24*i*, a restriction pin 53 for restricting the movement of the first and second switching pins 51 and 52, and a return spring 54 for urging the pins 51 to 53** to the side of releasing the connection.

At the first driving rocker arm **23*i* is opened in parallel with the rocker shaft 22*i* a first bottomed guide hole 55 opened at the side of the free rocker arm 25*i*, the first switching pin 51 is slidably fitted into the first guide hole 55, and a hydraulic pressure chamber 56 is defined between the one end of the first switching pin 51 and the closed end of the first guide hole 55. Further, at the first driving rocker arm 23*i* is opened a passage 57 communicating with the hydraulic pressure chamber 56, a lubricant supply passage 58*i* is provided in the rocker shaft 22*i*, and the lubricant supply passage 58*i* always communicates with the hydraulic pressure chamber 56 through a passage 57 irrespective of the rocking state of the first driving rocker arm 23*i***.

At the free rocker arm **25*i* is opened a guide hole 59 corresponding to the first guide hole 55 over both sides in parallel with the rocker shaft 22*i*, and the second switching pin 52 contacted at one end with the other end of the first switching pin 51 is slidably fitted into the guide hole 59**.

At the second driving rocker arm **24*i* is opened a second bottomed guide hole 60 corresponding to the guide hole 59 at the side of the free rocker arm 25*i* in parallel with the rocker shaft 22*i*, and the disc-like restriction pin 53 contacted with the other end of the second switching pin 52 is slidably fitted into the second guide hole 60. Further, a guide cylinder 61 is fitted to the closed end of the second guide hole 60, and a shaft 62 slidably fitted into the guide cylinder 61 is coaxially and integrally projected at the restriction pin 52. The return spring 54 is disposed between the guide cylinder 61 and the restriction pin 53, and the pins 51, 52, 53 are urged by the return spring 54 to the side of the hydraulic pressure chamber 56**.

In such a connection switching mechanism **26*i*, when the hydraulic pressure of the hydraulic pressure chamber 56 is raised, the first switching pin 51 is fitted into the guide hole 59, and the second switching pin 52 is fitted into the second guide hole 60 to connect the rocker arms 23*i*, 25*i*** *and 24i*. When the hydraulic pressure of the hydraulic pressure chamber 56 is, on the other hand, lowered, the first switching pin 51 is returned by the resilient force of the return spring 54 at the contacting surface with the second switching pin 52 to a position corresponding to between the first driving rocker arm **23*i* and the free rocker arm 25*i*, and the second switching pin 52 is returned at the contacting surface with the restriction pin 53 to a position corresponding to between the free rocker arm 25*i* and the second driving rocker arm 24*i*. Thus, the connecting state of the rocker arms 23*i*, 25*i* and 24*i*** is disconnected.

Then, referring to FIG. 7, a lubricant supplying system to both the valve actuating units **17*i* and 17*e* will be described. To the exhaust port of an oil pump 64 for pumping lubricant from an oil pan 63 are connected an oil gallery 68 through a relief valve 65, an oil filter 66 and an oil cooler 67, the hydraulic pressure is supplied from the oil gallery 68 to the respective connection switching mechanisms 26*i*, 26*e*, and lubricant is supplied to the portions to be lubricated of the valve actuating units 17*i* and 17*e***.

To the gallery 68 are connected lubricant supply passages **58*i* and 58*e* in the rocker shafts 22*i* and 22*e* through a switching valve 69 for switching the hydraulic pressure passed through a filter 70 provided on the way thereto to high or low pressure to supply it. Further, the lubricant supply passages 58*i* and 58*e* are so formed in a tapered shape as to increase in diameter the one end thereof at the side of the switching valve 69** and to decrease in diameter the other end thereof.

On the upper surfaces of the cam holders 29, 29 and 30, . . . are screwed passage forming members **72*i* and 72*e* extended in parallel corresponding to both the cam shafts 18*i* and 18*e* by a plurality of bolts 73. Further, at the passage forming members 72*i* and 72*e* are provided in parallel low speed lubricant passages 74*i* and 74*e* closed at both ends, and high speed lubricant passages 75*i* and 75*e* communicating with the lubricant supply passages 58*i* and 58*e* through throttles 76*i* and 76*e***.

Figure 7:
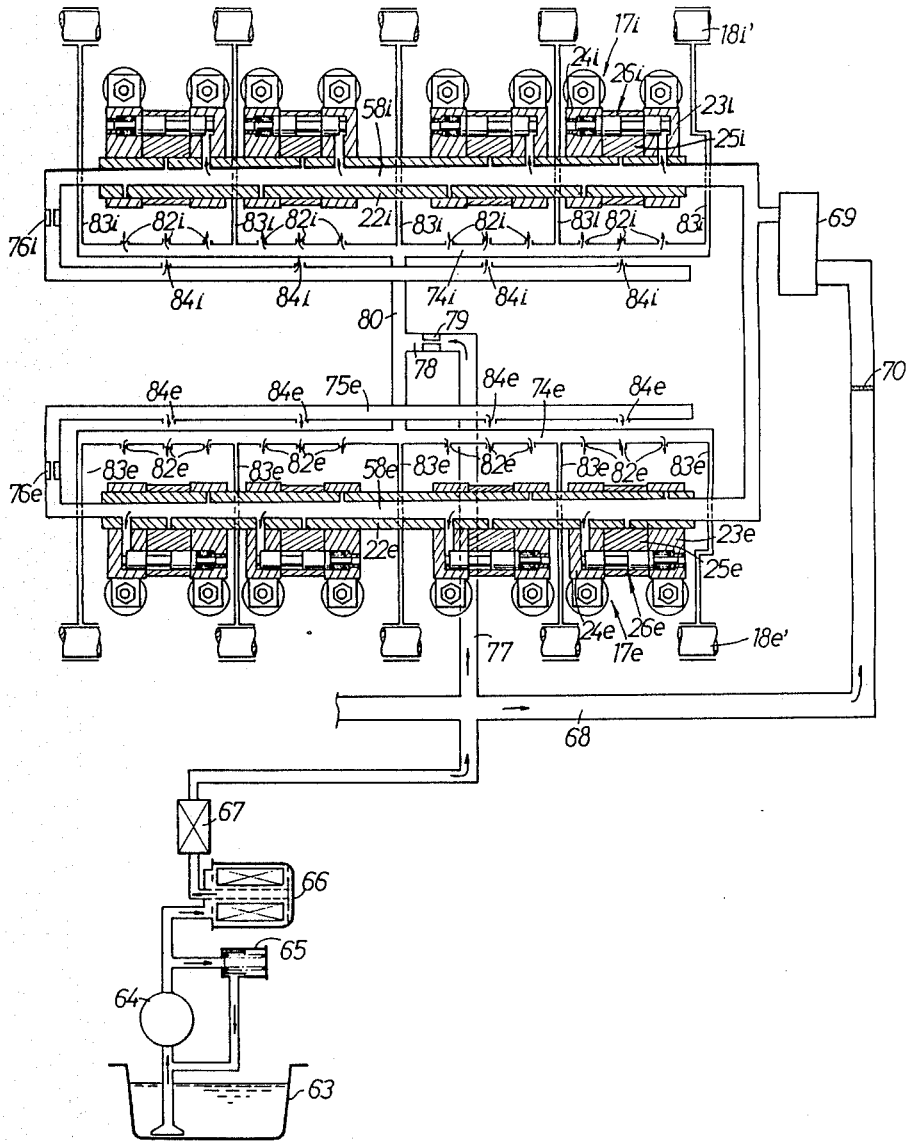

As shown in FIGS. 5 and 7, a lubricant passage 77 having a throttle 79 on the way to be branched from the oil gallery 68 at the upstream side from the filter 70 is provided to be extended upwards in the cylinder block 1. Further, the passage 77 is provided in the cylinder block 1 substantially at the center along the arranging direction of the respective cylinders 2. On the other hand, a low speed hydraulic pressure supply passage 78 communicating with the passage 77 is provided in the cam support 28 substantially at the center along the arranging direction of the respective cylinders 2, and the supply passage 78 includes an annular passage portion **78*a* for surrounding the bolt 33, a passage portion 78*b* extended to the center between both the valve actuating units 17*i* and 17*e* in communication with the upper end of the passage portion 78*a*, and a passage portion 78*c* extended upward in communication with the passage portion 78*b* and opened at the upper surface of the cam support 28**.

At the cam holder 30 disposed substantially at the center along the arranging direction of the respective cylinders 2 is provided a substantially Y-shaped branch lubricant passage 80 branched to both the valve actuating units **17*i* and 17*e* in communication at the upper end with the lower end of the passage portion 78*c* in the low speed hydraulic pressure supply passage 78, and the upper end of the branch lubricant passage 80 communicates at the upper end with the low speed lubricant passages 74*i* and 74*e*. That is, communication holes 81*i* and 81*e* are opened at the passage forming members 72*i* and 72*e*, respectively in communication of the branch lubrication passage 80 with the low speed lubricant passages 74*i* and 74*e***.

The low speed lubricant passages **74*i* and 74*e* supply lubricant to the slidably contacting portions of the cams 19*i*, 19*e*; 20*i*, 20*e*; 21*i*, 21*e* with the rocker arms 23*i*, 23*e*; 24*i*, 24*e*; 25*i*, 25*e*, and the cam journals 18*i*' and 18*e*' of the cam shafts 18*i* and 18*e*. Thus, on the lower surface of the passage forming members 72*i* and 72*e* are opened lubricant discharging holes 82*i* and 82*e* communicating with the low speed lubricant passages 74*i* and 74*e* at positions corresponding to the low speed cams 19*i*, 19*e*; 20*i*, 20*e* and high speed cams 21*i* and 21*e*, and lubricant supply passages 83*i* and 83*e* communicating with the low speed lubricant passages 74*i* and 74*e* to supply the lubricant to the cam journals 18*i*' and 18*e*' of the cam shafts 18*i* and 18*e***.

The high speed lubricant passages **75*i* and 75*e* supply the lubricant to the slidably contacting portions of the high speed cams 21*i* and 21*e* with the free rocker arms 25*i* and 25*e*, and on the lower surfaces of the passage forming members 72*i* and 72*e* are opened lubricant discharging holes 84*i* and 84*e* communicating with the high speed lubricant passages 75*i* and 75*e* at positions corresponding to the high speed cams 21*i* and 21*e***.

The passage forming members **72*i* and 72*e* are disposed above the cam shafts 18*i* and 18*e*, and the lubricants discharged from the lubricant discharging holes 84*i* and 84*e* are scattered partly to the sides in response to the rotations of the cam shafts 18*i* and 18*e*. Further, since both the cam shafts 18*i* and 18*e* are rotated in the same direction, the lubricant discharged from one lubricant discharging hole 84*i* is partly scattered to the side of the exhaust side valve actuating unit 17*e*, while the lubricant discharged from the other lubricant discharging hole 84*e* is scattered partly toward the opposite side to the intake side valve actuating unit 17*i*. In addition, since the central blocks 36, 49 are provided between both the valve actuating units 17*i* and 17*e* of the portions corresponding to the lubricant discharging holes 84*i* and 84*e*, the scattered lubricant is partly reflected on the central blocks 36, 49 and returned to a side of the slidably contacting portion of the high speed cam 21*i* with the free rocker arm 25*i*. The lubricant scattered from the lubricant discharging hole 84*e* is partly contacted with the side of the cylinder head 3, reflected and returned to a side of the slidably contacting portion of the high speed cam 21*e* with the free rocker arm 25*e*. However, the distances between the slidably contacting portion of the high speed cam 21*i* with the free rocker arm 25*i* and the central blocks 36, 49 are shorter than that between the slidably contacting portions of the high speed cam 21*e* with the free rocker arm 25*e* and the side of the cylinder head 3, and the lubricant amount reflected from the central blocks 36, 49 and returned to the slidably contacting portion of the high speed cam 21*i* with the free rocker arm 25*i* is more than that reflected from the side of the cylinder head 3 and returned to the slidably contacting portion of the high speed cam 21*e* with the free rocker arm 25*e*. Therefore, the diameter of the lubricant discharging hole 84*i* is set to be smaller than that of the lubricant discharging hole 84*e*, and the lubricant discharging amount from the lubricant discharging hole 84*i* is set accordingly less than that of the lubricant discharging hole 84*e*. Further, the throttle degree of the throttle 76*i* provided between the lubricant supply passage 58*i* and the high speed lubricant passage 75*i* is set smaller than that of the throttle 76*e* provided between the lubricant supply passage 58*e* and the high speed lubricant passage 75*e*, and the lubricant amount supplied to the high speed lubricant passage 75*i* is accordingly set smaller than that supplied to the high speed lubricant passage 75*e***.

Since the lubricant discharging holes **82*i* and 82*e* communicating with the low speed lubricant passages 74*i* and 74*e* have substantially equal distances between the members for reflecting the lubricant in a direction for scattering the lubricant by the rotations of the cam shafts 18*i* and 18*e* and the slidably contacting portions of the low speed cams 19*i*, 19*e*; 20*i*, 20*e* with the first and second driving rocker arms 23*i*, 23*e*; 24*i*, 24*e*, the bore diameters of the holes 82*i* and 82*e*** are set substantially the same.

Figure 8:
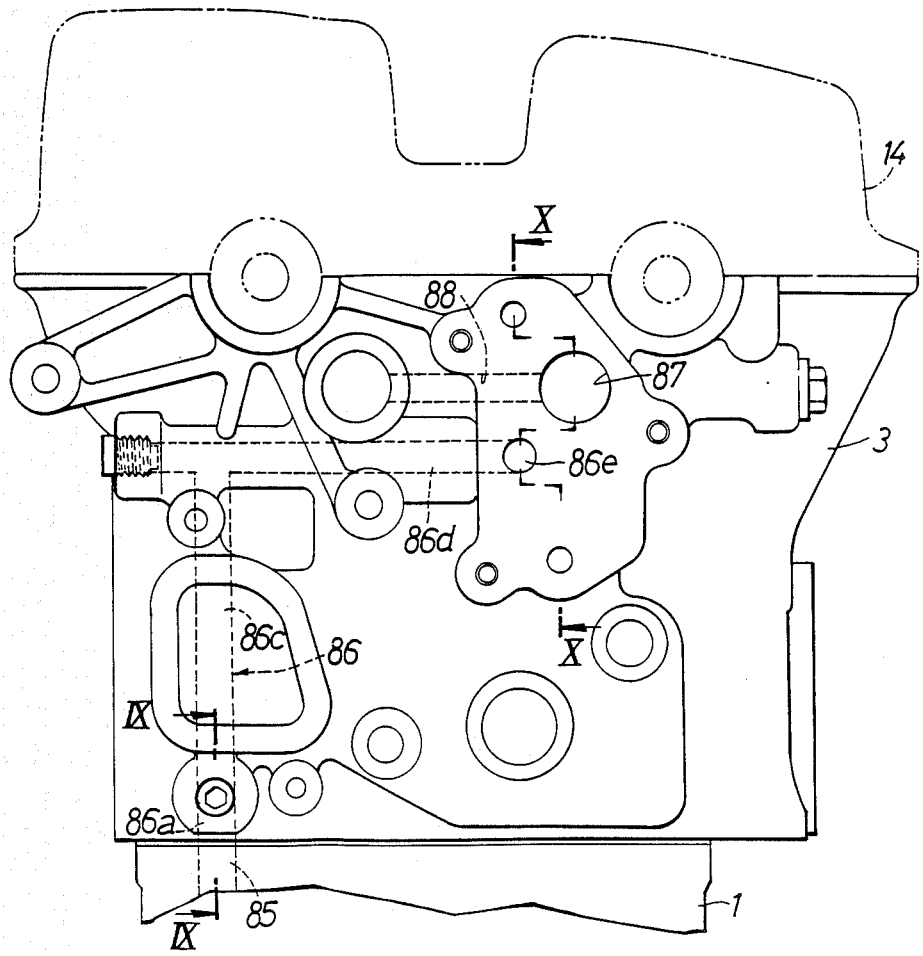
Figure 9:
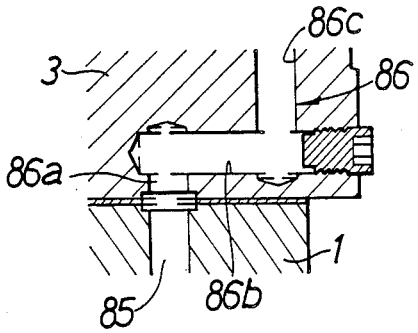

In FIGS. 8 and 9, a lubricant passage 85 extended upwards and downwards near one end along the arranging direction of the respective cylinders 2 is provided independently from the passage 77 in the cylinder block 1, and communicates through the filter 70 (FIG. 7) with the lubricant gallery 68. On the other hand, a high speed hydraulic pressure supply passage 86 communicating with the lubricant passage 85 is provided in the cylinder head 3 at one end thereof along the arranging direction of the cylinders 2, and the supply passage 86 includes a passage portion **86*a* extended upwards slightly in communication with the upper end of the passage 85, a passage portion 86*b* further extended to the one end side of the cylinder head 3 in communication with the upper end of the passage portion 86*a*, a passage portion 86*c* extended upwards in communication with the passage portion 86*b*, a passage portion 86*d* extended to the rocker shaft 22*e* side of the exhaust valve side valve actuating unit 17*e* in communication with the upper end of the passage portion 86*c*, and a passage portion 86*e* opened at one end face of the cylinder head 3 in communication with the passage portion 86*d***.

Figure 10:
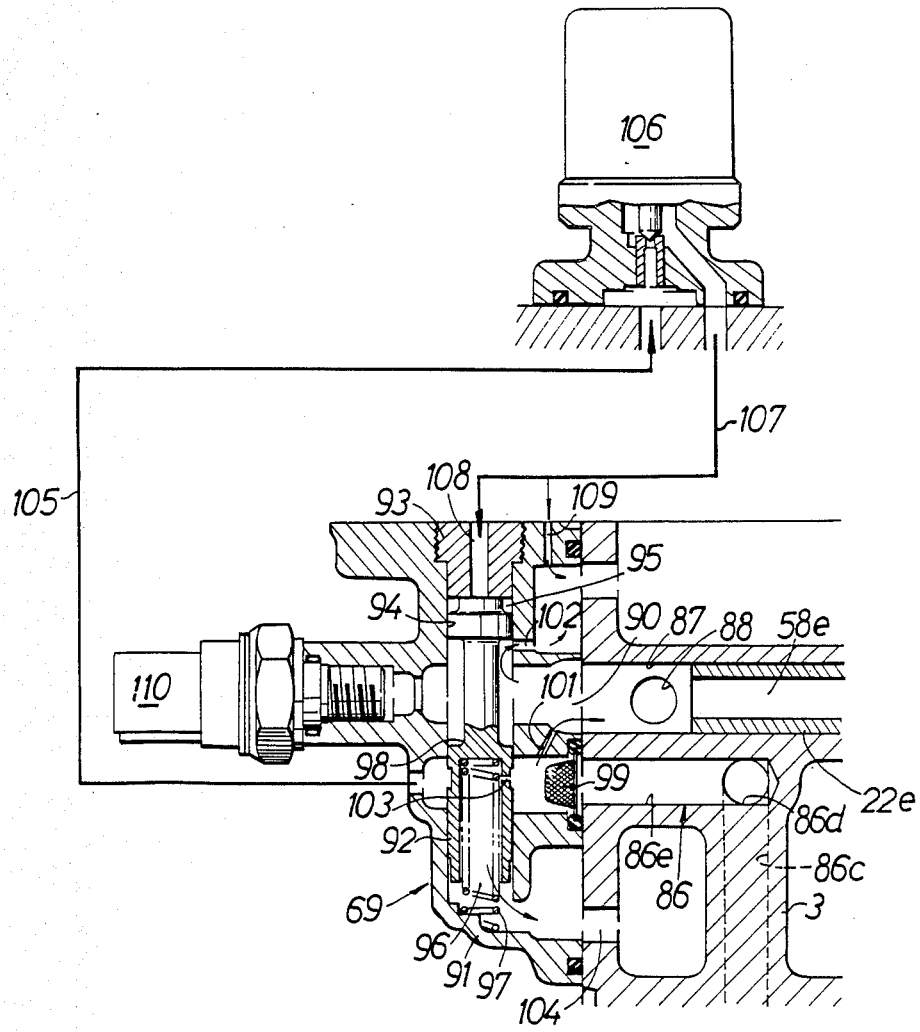

Referring also to FIG. 10, at one of the rocker shafts 22*i* and 22*e*, i.e., the portion for supporting one end of the exhaust side rocker shaft 22*e* is opened a lubricant supply port 87 in communication with the lubricant supply passage portion 58*e* in the rocker shaft 22*e* to open at one end face of the cylinder head 3. At the cylinder head 3 is opened a communication passage 88 for communicating at the lubricant supply port 87 with the lubricant supply passage 58*i* in the intake side rocker shaft 22*i*.

The switching valve 69 is mounted on one end face of the cylinder head 3 to switch the connection and the disconnection between the opening to one end face of the cylinder head 3, i.e., the passage portion 86*e* and the lubricant supply port 87, and includes a spool valve body 92 slidably fitted into a housing 91 having an inlet port 89 communicating with the passage portion 86*e* and an outlet port 90 communicating with the lubricant supply port 87 and mounted on one end face of the cylinder head 3.

In the housing 91 is opened a cylinder bore 94 closed at its upper end with a cap 93 at an axis extending vertically, and the spool valve body 92 is slidably fitted into the cylinder bore 94 by forming an operation hydraulic pressure chamber 93 between the spool valve body and the cap 93. When the cylinder bore 94 is formed at its axis in a vertical direction in this manner, the weight of the spool valve body 92 is not applied to the sliding surface with the bore 94, thereby smoothly operating the spool valve body 92.

In a spring chamber 96 formed between the lower portion of the housing 91 and the spool valve body 92 is contained a spring 97 for urging the spool valve body 92 upwards, i.e., in a closing direction. On the spool valve body 92 is formed an annular recess 98 communicating between the inlet port 89 and the outlet port 90. As shown in FIG. 10, when the spool valve body 92 moves upwards, the spool valve body 92 is in a state to cut off the communication between the inlet port 89 and the outlet port 90.

An oil filter 99 is interposed between the inlet port 89 and the high speed hydraulic pressure supply passage 88*e* in the state that the housing 91 is mounted on the end face of the cylinder head 3. In the housing 91 is opened an orifice hole 101 communicating between the inlet port 89 and the outlet port 90. Accordingly, between the inlet port 89 and the outlet port 90 is communicated through the orifice hole 101 even in the state that the spool valve body 92 is closed, and the hydraulic pressure throttled by the orifice hole 101 is supplied from the outlet port 90 to the lubricant supply port 87.

In the housing 91 is also opened a bypass port 102 communicating with the outlet port 90 through an annular recess 98 only when the spool valve body 92 is disposed at its closed position, and the bypass port 102 communicates with the upper portion in the cylinder head 3. Further, at the spool valve body 92 is opened an orifice hole 103 communicating at the inlet port 89 with the spring chamber 96 irrespective of the position of the spool valve body 92. Further, in the lower portion of the housing 91 is opened a through hole 104 communicating at the spring chamber 96 with the cylinder head 3, and the lubricant fed through the orifice hole 103 into the spring chamber 96 is returned from the through hole 104 into the cylinder head 3. Thus, since dusts adhered to the spring 97 are fed out by the lubricant, the dusts are avoided to affect the adverse influence to the extending and contracting operations of the spring 97.

A conduit 105 always communicating with the inlet port 89 is connected to the housing 91, and the conduit 105 is connected through a solenoid valve 106 to a conduit 107. Further, the conduit 107 is connected to a connection hole 108 opened at the cap 93. Therefore, when the solenoid valve 106 is opened, the hydraulic pressure is supplied into the operation hydraulic pressure chamber 95, and the spool valve body 92 is driven in a valve opening direction by the hydraulic force of the hydraulic pressure introduced into the operation hydraulic pressure chamber 95.

In the housing 91 is opened a leakage jet 109 communicating with the intermediate portion of the conduit 107, and the leakage jet 109 communicates with the upper portion in the cylinder head 3. This leakage jet 109 operates to escape the hydraulic pressure remaining in the conduit 107 when the solenoid valve 106 is closed.

Further, in the housing 91 is mounted a pressure detector 110 for detecting the hydraulic pressures of the outlet port 90, i.e., the lubricant supply passages 58*i* and 58*e*, and the pressure detector 110 operates to detect whether the switching valve 69 is normally operated or not.

Figure 11:
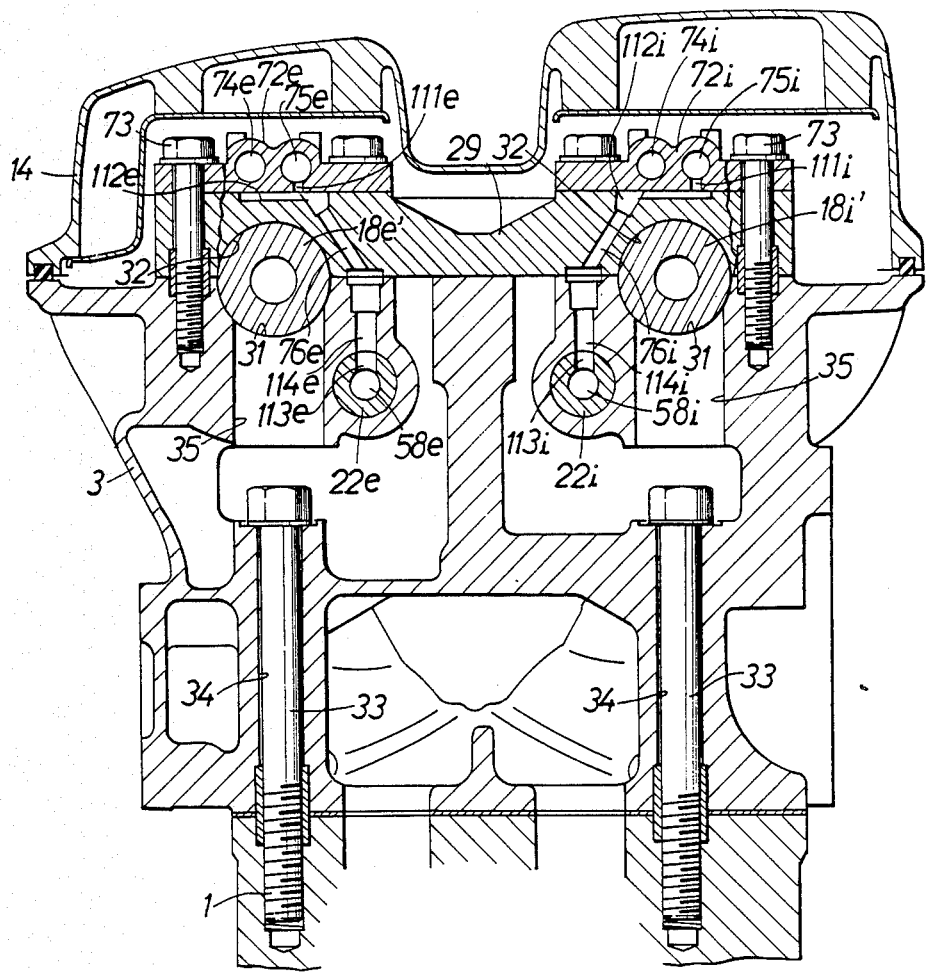

In FIG. 11, at the ends of the passage forming members 72*i* and 72*e* at the other end side of the cylinder head 3, i.e., at the opposite side to the mounting position of the switching valve 69 are opened communication holes 111*i* and 111*e* communicating with the high speed lubricant passages 75*i* and 75*e*, and on the upper surface of the cam holder 29 are formed a pair of grooves to form passages 112*i* and 112*e* communicating with the holes 111*i* and 111*e* between the passage forming members 72*i* and 72*e*. On the ends of the rocker shafts 22*i* and 22*e* are opened communication holes 113*i* and 113*e* communicating with the lubricant supply passages 58*i* and 58*e*, and the passages 114*i* and 114*e* opened at the cylinder head 3 in communication with the holes 113*i* and 113*e* communicate through the throttles 76*i* and 76*e* opened at the cam holder 29 with the passages 112*i* and 112*e*, respectively. Accordingly, the lubricant supplied to the lubricant supply passages 58*i* and 58*e* are supplied through the throttles 76*i* and 76*e* to the high speed lubricant passages 75*i* and 75*e*.

The operation of the embodiment described above will now be described. Since the lubricant is supplied through the lubricant passage 77 independent from the connection switching mechanisms 26*i* and 26*e*, low speed hydraulic pressure supply passage 78 and the branch lubricant passage 80 to the low speed lubricant passages 74*i* and 74*e*, even if the hydraulic pressure is controlled by the switching valve 69 to operate the connection switching mechanisms 26*i* and 26*e*, the predetermined hydraulic pressure can be always supplied irrespective of the operations, and the lubricant can be supplied under stable pressure to the slidably contacting portions of the low speed cams 19*i*, 19*e*; 20*i*, 20*e* with the rocker arms 23*i*, 23*e*; 24*i*, 24*e*, the slidably contacting portions of the high speed cams 21*i*, 21*e* with the free rocker arms 25*i*, 25*e*, and the cam journals 18*i*' and 18*e*' of the cam shafts 18*i* and 18*e*.

Further, since the lubricant passage 77, the low speed hydraulic pressure supply passage 78 and the branch lubricant passage 80 are arranged substantially at the center along the arranging direction of the respective cylinders 2, the flowing pressure losses of the lubricant to the lubricant discharging holes 82*i* and 82*e*, and the lubricant supply passages 83*i* and 83*e* can be maintained substantially constant to substantially uniformize the lubricant amount.

Figure 12:
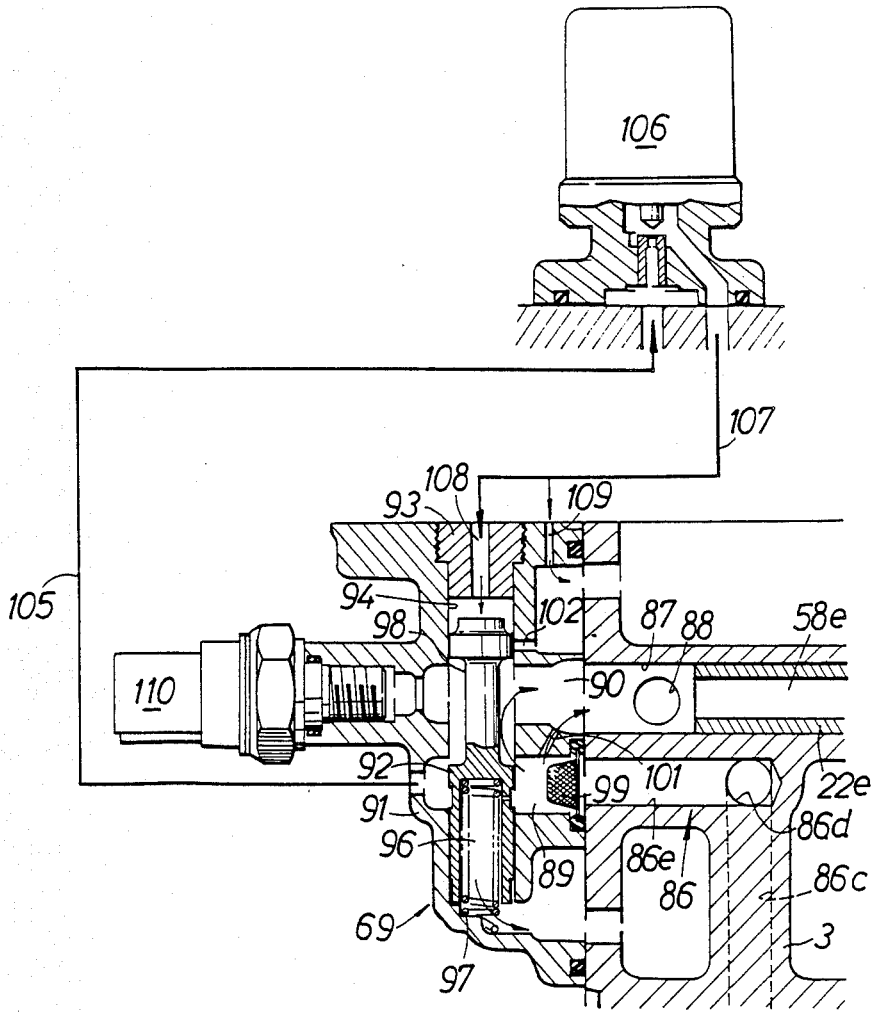

When the connection switching mechanisms **26*i* and 26*e* are switched to set the intake and exhaust valves 10*i* and 10*e* to high speed operation state, the switching valve 69 is opened as shown in FIG. 12. Namely, the solenoid valve 106 is opened to supply the hydraulic pressure to the operation hydraulic pressure chamber 95 to open the spool valve body 92, thereby supplying the hydraulic pressure to the lubricant supply passages 58*i* and 58*e*. Thus, the hydraulic pressure is supplied to the hydraulic pressure chamber 56 to connect to operate the connection switching mechanism 26, thereby opening or closing the exhaust valve 10*e*** in high speed operation state.

Further, since the lubricant supply passages **58*i* and 58*e* are formed in the tapered shape with large diameter at the side of the switching valve 69 when the hydraulic pressure to the passages 58*i* and 58*e* is switched in this manner, the flowing sectional area is reduced as the number of the connection switching mechanisms 26*i* and 26*e* for supplying the hydraulic pressure is decreased, thereby substantially maintaining the flowing velocity of the hydraulic pressure along the axial direction of the lubricant supply passages 58*i* and 58*e*. Accordingly, the displacement of the hydraulic pressure operating timing to the hydraulic pressure connection switching mechanisms 26*i* and 26*e* arranged at an axial interval of the supply passages 58*i* and 58*e* is avoided as much as possible, and the operation altering timing of the intake and exhaust valves 10*i* and 10*e* in the respective cylinders 2** can be brought substantially into coincidence.

The lubricant supplied to the high speed lubricant passages **75*i*, 75*e* is discharged from the lubricant discharging holes 84*i* and 84*e* in the above-described high speed operation state, and the lubrication of the slidably contacting portions of the high speed cams 21*i* and 21*e* with the free rocker arms 25*i* and 25*e* in which the surface pressures are particularly increased can be sufficiently conducted. Further, since the the diameters of the lubricant discharging holes 84*i* and 84*e* are set in response to the distance between the member for reflecting the lubricant scattered in response to the rotations of the cam shafts 18*i* and 18*e* and the slidably contacting portions of the high speed cams 21*i* and 21*e* with the free rocker arms 25*i* and 25*e* and the throttling degrees of the throttles 76*i* and 76*e*** are set, the lubricant amounts supplied to the slidably contacting portions can be substantially uniformized.

When the switching valves **69*i* and 69*e* are switched to switch the low speed operation state to the high speed operation state, there is a slight time lag until the hydraulic pressures of the high speed lubricant passages 75*i* and 75*e* are increased due the throttles 76*i* and 76*e*, and there is a slight time delay until the lubricant is discharged from the lubricant discharging holes 84*i* and 84*e*. However, since the lubricant discharging holes 82*i* and 82*e* communicating with the low speed lubricant passages 74*i* and 74*e* are also arranged at the positions corresponding to the slidably contacting portions of the high speed cams 21*i* and 21*e* with the free rocker arms 25*i* and 25*e*, even if there is the slight time delay as described above, the lubricant is not insufficient at the slidably contacting portions of the high speed cams 21*i* and 21*e* with the free rocker arms 25*i* and 25*e*. When the switching valve 69 is closed to generate the low speed operation state while the pins 51, 52, 53 remain locked at the connection switching mechanisms 26*i* and 26*e*, the surface pressures of the slidably contacting portions of the high speed cams 21*i* and 21*e* with the free rocker arms 25*i* and 25*e* become high the same as that at the time of high speed operation state. However, at this time, the lubricant is discharged from the lubricant discharging hole 82*i* and 82*e* communicating with the low speed lubricant passages 74*i* and 74*e* to the slidably contacting portions of the high speed cams 21*i* and 21*d* with the free rocker arms 25*i* and 25*e***, and the sufficient lubricant can be accordingly supplied thereto.

When the opening and closing operation states of the intake and exhaust valves **10*i* and 10*e* are switched from high speed operation state to the low speed operation state, the solenoid valve 106 is closed. When the solenoid valve 106 is closed, the hydraulic pressure in the conduit 107 is escaped from the leakage jet 109 to rapidly release the hydraulic pressure of the operation hydraulic pressure chamber 95, and the switching valve 69 is rapidly closed in response to the release of the hydraulic pressure. Further, when the switching valve 69 is closed, the hydraulic pressures in the lubricant supply passages 58*i*and 58*e* are escaped through the bypass port 102 into the cylinder head 3. Accordingly, the hydraulic pressure in the hydraulic pressure chamber 56 in the lubricant supply passages 58*i* and 58*e*, i.e, the connection switching mechanism 26*i* and 26*e*** is rapidly reduced, thereby improving the switching responsiveness of the high speed operation state to the low speed operation state.

In such a lubricant supplying system, the low and high speed hydraulic pressure supply passages 78 and 86 may be provided each one in the cylinder head 3. Therefore, the fabrication of the cylinder head 3 can be very facilitated. Further, since the switching valve 69 is mounted on one end face of the cylinder head 3, its mounting structure becomes simple. Moreover, since the lubricant supply passages **58*i* and 58*e* are commonly used to supply the lubricant to the connection switching mechanisms 26*i* and 26*e* and to the high speed lubricant passages 75*i* and 75*e*, it is unnecessary to provide separately the lubricant supply conduits and the lubricant supply passages in the cylinder head 3**, thereby efficiently supplying the lubricant while avoiding the increases in the number of components and the number of manufacturing steps.

Figure 13:
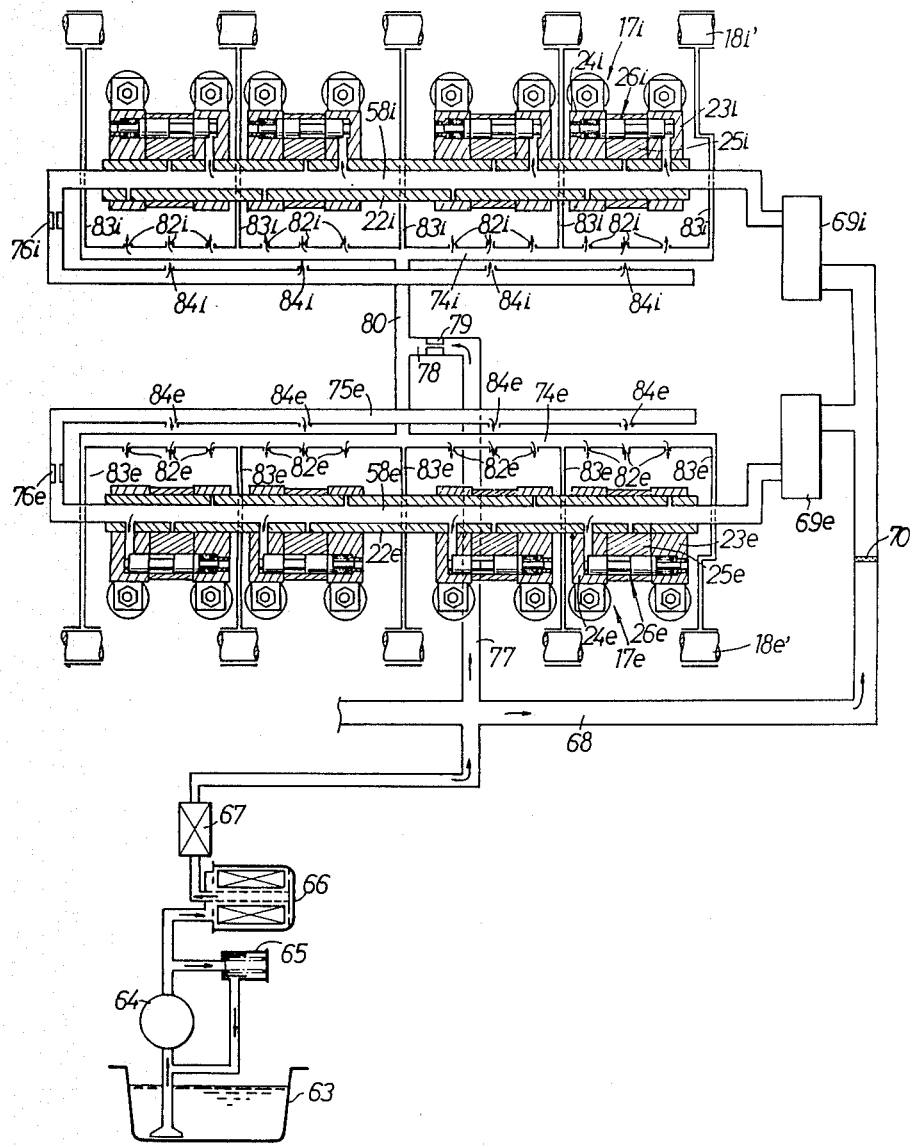
Figure 14:
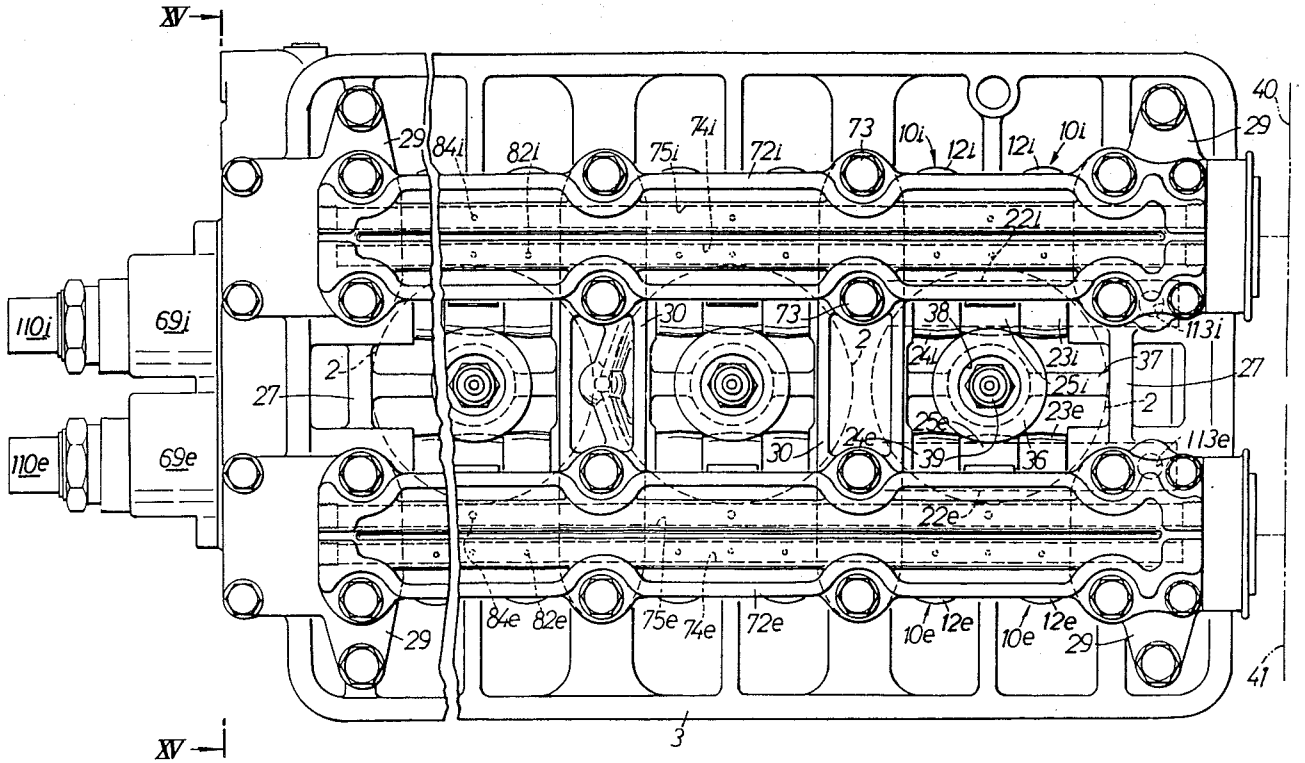
Figure 15:
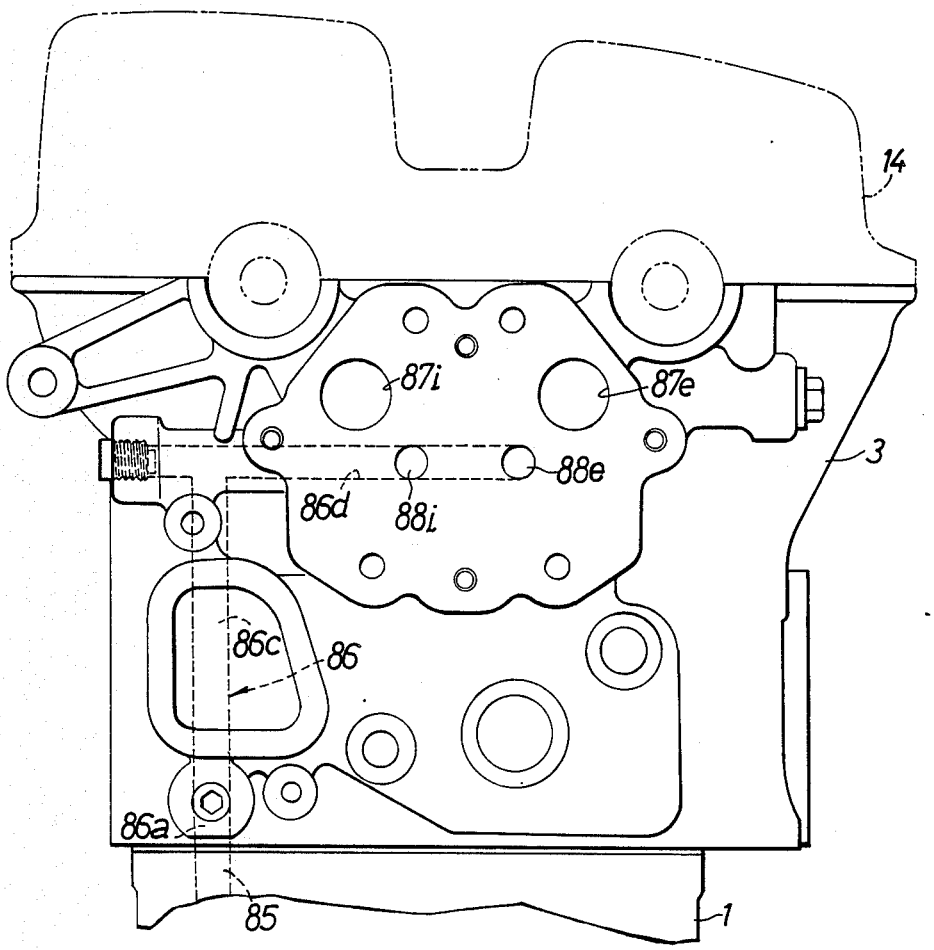

FIGS. 13 to 15 show another embodiment of the present invention, wherein corresponding parts will be indicated by corresponding numerals and characters in the embodiments.

Switching valves **69*i* and 69*e* are connected in parallel for switching hydraulic pressure passed through a filter 70 provided on the way in an oil gallery 68 communicating with an oil pump 64 to high or low pressure to be supplied, and lubricant supply passages 58*i* and 58*e* in rocker shafts 22*i* and 22*e* are connected through corresponding switching valves 69*i* and 69*e* to the oil gallery 68. Further, pressure detectors 110*i* and 110*e* are provided in the switching valves 69*i* and 69*e***, respectively.

In a cylinder head 3 are opened hydraulic pressure supply passages **88*i* and 88*e* opened to one end face of the cylinder head 3 in communication with the passages portion 86*d* of a high speed hydraulic pressure supply passage 86. Further, at the portions of the cylinder head 3 for supporting the one ends of both the rocker shafts 22*i* and 22*e* are lubricant supply passages 87*i* and 87*e* communicating with the lubricant supply passages 58*i*** and 58e in the rocker shafts 22i and 22e to be opened to one end face of the cylinder head 3.

The switching valves 69i and 69e are mounted at one end face of the cylinder head 3 to switch the connection and the disconnection between the hydraulic pressure supply passages 88i and 88e and the lubricant supply passages 87i and 87e, and the valves 69i and 69e are arranged fundamentally identical with the switching valve 69 of the previous embodiment while the housing 91 is common.

According to the embodiments described above, the switching valves 69i and 69e are individually controlled in their operations to independently control the supply and the stop of the lubricant to the lubricant supply passages 58i and 58e of the intake and exhaust sides to control the movements of the valves by differentiating the operation states of the intake and exhaust valves 10i and 10e, thereby increasing the degree of freedoms of controlling the moving valves.

What is claimed is:

1. A lubricant supplying system for a DOHC type multi-cylinder internal combustion engine comprising a plurality of cylinders arranged in series in a cylinder block, a pair of cam shafts parallel to each other and rotatably supported by a cylinder head and cam holders fixed to the cylinder head at opposite sides of the respective cylinders along the cylinder arranging direction, a plurality of cams including low speed cams corresponding to intake and exhaust valves of the respective cylinders and fixed to the cam shafts, a plurality of rocker arms disposed to be slidably contacted with the respective cams and corresponding to each of the intake and exhaust valves of the respective cylinders, and a connection switching mechanism for switching connection and disconnection of the rocker arms in response to a hydraulic pressure to vary operating states of the intake and exhaust valves responsive to an operating state of the engine, wherein a hydraulic pressure supply passage independent from an oil supply passage for supplying a hydraulic pressure to the connection switching mechanism is provided in the cylinder head substantially at a center portion thereof in the arranging direction of the cylinders so as to extend vertically, and a branch oil passage is provided to have intake side and exhaust side portions disposed in one cam holder of substantially central location along the arranging direction of the respective cylinders, the branch oil passage communicating with an upper end of the hydraulic pressure supply passage to supply lubricant to slidably contacting portions of the low speed cams of the respective cylinders for the intake and exhaust valves with the rocker arms and to cam journal portions of the cam shafts.

2. A lubricant supplying system for a DOHC type multi-cylinder internal combustion engine comprising a plurality of cylinders arranged in series in a cylinder block, a pair of cam shafts parallel to each other and rotatably supported by a cylinder head and cam holders fixed to the cylinder head at opposite sides of the respective cylinders along the cylinder arranging direction, a plurality of cams arranged adjacent to each other and including a low speed cam and a high speed cam and fixed to the cam shafts so as to correspond to the respective cylinders, a plurality of rocker arms corresponding to the intake and exhaust valves of the respective cylinders and supported by a pair of rocker shafts fixedly supported by the cylinder head for slidable contact with the respective cams, and a connection switching mechanism for switching connection and disconnection of the rocker arms in response to a hydraulic pressure to vary operating states of the intake and exhaust valves responsive to an operating state of the engine, wherein a low speed hydraulic pressure supply passage is provided in the cylinder head substantially at a center portion thereof along the arranging direction of the respective cylinders in the cylinder head, and a high speed hydraulic pressure supply passage is provided to open to one end face of the cylinder head along the arranging direction of the respective cylinders in a manner independent from the low speed hydraulic pressure supply passage, a branch oil passage being provided to have intake side and exhaust side portions disposed in one cam holder of substantially central location along the cylinder arranging direction for supplying oil to slidably contacting portions of the cams including at least the low speed cams of the respective cylinders for the intake and exhaust valves with the rocker arms and to cam journal portions of the cam shafts, the branch oil passage communicating with the low speed hydraulic pressure supply passage, wherein the connection switching mechanisms and an oil supply passage for supplying oil to sliding contacting portions of the high speed cams with the rocker arms are coaxially provided in the rocker shafts, an oil supply port for communicating with the oil supply passage is provided in the cylinder head near one end thereof along the cylinder arranging direction so as to open to one end face of the cylinder head, and a switching valve for switching communication and disconnection between an opening of the high speed hydraulic pressure supply passage and the oil supply port is mounted to the one end face of the cylinder head.

3. A lubricant supplying system for a DOHC type multi-cylinder internal combustion engine according to claim 1 or 2, wherein the low speed cams and high speed cams are provided on the cam shaft, a low speed lubricant passage communicating with a lubricant discharging hole for discharging lubricant toward the slidably contacting portions of the low speed cams with the rocker arms and a high speed lubricant passage communicating with a lubricant discharging hole for discharging lubricant toward the slidably contacting portions of the high speed cams with the rocker arms and connected to the connection switching mechanism through a throttle are provided independently from each other, and a lubricant discharging hole communicating with the low speed lubricant passage to discharge the lubricant toward the slidably contacting portions of the high speed cams with the rocker arms is formed in passage forming members for forming the low speed lubricant passage.

4. A lubricant supplying system for a DOHC type multi-cylinder internal combustion engine according to claim 3, wherein the lubricant discharging hole for discharging the lubricant toward the slidably contacting portions of the cams provided on one of the cam shafts with the rocker arms, and the lubricant discharging hole for discharging the lubricant toward the slidably contacting portions of the cams provided on the other cam shaft with the rocker arms are disposed above the cam shafts, and one of the lubricant discharging holes having a distance between a cylinder head portion on the side scattered with the lubricant in response to rotation of both the cam shafts and the corresponding slidably contacting portion set smaller than that of the other lubricant discharging hole is formed to have a diameter smaller than the other lubricant discharging hole.

5. A lubricant supplying system for a DOHC type multi-cylinder internal combustion engine according to claim 2, wherein a pair of oil supply ports individually communicating with the oil supply passages provided in intake side and exhaust side rocker shafts and a pair of hydraulic pressure supply passages communicating with the hydraulic pressure supply source are provided in the cylinder head to open to a side end face of the cylinder head, and a pair of switching valves for individually switching connection and disconnection between one of the oil supply ports and one of the hydraulic pressure supply passages, and between the other oil supply port and the other hydraulic pressure supply passage are mounted on said side end face of the cylinder head.

6. A lubricant supplying system for a DOHC type multi-cylinder internal combustion engine according to claim 1 or 2, wherein an oil supply passage communicating with the connection switching mechanism is provided in the rocker shaft, and the oil supply passage is formed in a tapered shape to increase in diameter at one end side communicating with the hydraulic pressure supply source and to decrease in diameter toward the other end side.

* * * * *